United States Patent [19]

Cross et al.

[11] Patent Number: 4,793,154

[45] Date of Patent: Dec. 27, 1988

[54] CENTRIFUGAL HEAT PUMP

[75] Inventors: William T. Cross, Cuddington; Colin Ramshaw, Norley, both of England

[73] Assignee: Imperial Chemical Industries PLC, London, England

[21] Appl. No.: 750,276

[22] Filed: Jul. 1, 1985

Related U.S. Application Data

[63] Continuation-in-part of Ser. No. 588,103, Mar. 9, 1984, abandoned.

[30] Foreign Application Priority Data

Mar. 22, 1983 [GB] United Kingdom ..... 8308137

[51] Int. Cl.[4] ..... F25B 3/00

[52] U.S. Cl. ..... 62/499

[58] Field of Search ..... 62/448, 498, 325, 115, 62/401, 499

[56] References Cited

U.S. PATENT DOCUMENTS

| | | | |
|---|---|---|---|
| 2,498,661 | 2/1950 | Dybvig | 62/325 |
| 2,609,672 | 9/1952 | Wales . | |
| 2,788,644 | 4/1957 | Gustafson | 62/325 X |
| 2,979,921 | 4/1961 | Sampietro | 62/499 |
| 3,347,059 | 10/1967 | Laing | 62/325 |
| 3,456,454 | 7/1969 | Kantor | 62/101 |
| 3,740,966 | 6/1973 | Pravda | 62/476 |
| 3,877,515 | 4/1975 | Laing | 165/86 |
| 3,999,402 | 12/1976 | Nelson | 62/498 X |
| 4,022,032 | 5/1977 | Nott | 62/499 |
| 4,077,230 | 3/1978 | Eskeli | 62/401 |
| 4,144,721 | 3/1979 | Kantor | 62/499 X |

FOREIGN PATENT DOCUMENTS

| | | |
|---|---|---|
| 0046112 | 10/1981 | European Pat. Off. . |
| 0037854 | 10/1981 | European Pat. Off. . |
| 0058628 | 8/1982 | European Pat. Off. . |
| 0080328 | 6/1983 | European Pat. Off. . |
| 833049 | 6/1949 | Fed. Rep. of Germany . |
| 2385366 | 10/1978 | France . |
| 312317 | 4/1930 | United Kingdom . |
| 1042386 | 9/1966 | United Kingdom . |

*Primary Examiner*—Lloyd L. King

*Attorney, Agent, or Firm*—Cushman, Darby & Cushman

[57] ABSTRACT

A vapor compression heat pump is described which comprises an evaporator, a compressor and a condenser and in which at least the evaporator or the condenser is in the form of one or more rotatable plates across the thickness of which plate(s) a heat transfer takes place. Such a heat pump can be designed in compact form.

7 Claims, 6 Drawing Sheets

CENTRIFUGAL HEAT PUMP

This is a continuation-in-part of our copending application Ser. No. 588,103, filed Mar. 9, 1984, now abandoned.

This invention is concerned with heat pumps, of the compression type, and is a new form of heat pump which is of a rotary design.

Compression heat pumps have been developed within the last few decades to the point where pumps are now available suitable for industrial purposes or for the domestic heating market. Compared with more conventional forms of heating, in particular water boilers fired by oil, gas or solid fuel, they are expensive and cumbersome. However they are also more economical in operation than many other prior heating systems and there is therefore a continuing search for an improved, more compact design.

The main object of the present invention is to provide a new form of heat pump which is capable of being designed in very compact form.

According to the present invention there is provided a compression heat pump which comprises at least an evaporator, a compressor and a condenser, characterised in that at least one of the aforesaid components (excluding the compressor) is in the form of one or more rotatable plates, preferably a plurality of axially-spaced, parallel rotatable plates, across the thickness of which plates, a heat transfer takes place.

It is especially advantageous if each of the above mentioned components of the heat pump, that is evaporator, and condenser, is in the form of one or more rotatable plates across the thickness of which a heat transfer takes place.

By means of the present invention we have made it possible to design a compression heat pump in which every component, is mounted on a single shaft, in a compact design, and which is driven by a single source of rotary power.

Thus, in a particularly preferred form a rotary compression heat pump according to the present invention comprises:

(a) an evaporator, mounted upon a rotary shaft for rotation therewith and comprising at least one plate across a first face of which an ambient fluid source of heat may flow and across the second face of which condensed working fluid may flow and be evaporated therefrom;

(b) a condenser, mounted upon said rotary shaft for rotation therewith and comprising at least one plate to a first face of which vaporised working fluid under pressure may flow and across the second face of which a medium to be heated may flow;

(c) a compressor, mounted about said rotary shaft and adapted to be driven thereby, and capable of accepting vapourised working fluid from the evaporator and delivering it under pressure to the condenser;

(d) a flow restriction valve to maintain the pressure in the condenser at an elevated level; and (e) drive means to rotate said rotary shaft.

The plates used in the compression heat pump according to the present invention are typically in the form of discs or annuli.

The face of the plates in the condenser over which working fluid vapour flows and on which it condenses has a surface designed to discourage the formation of a continuous liquid film thereon. Preferably the face of the plates is treated such that (a) condensation of the working fluid vapour thereon occurs in a dropwise fashion and (b) its wettability is reduced such that formation of any continuous, stable liquid film is discouraged. Such treatments include provision of a coating of inter alia a suitable silicone or polytetrafluoroethylene on the surface of the plates.

The face of the plates in the evaporator over which flows the liquid working fluid and from which it is to be evaporated, may advantageously be treated so as to assist the retention of a continuous film of liquid thereon. Such treatment, which may be chemical, e.g. etching, or physical, e.g. sand-blasting, will in general be aimed at giving the surface an overall fine roughness.

The thickness of the plates employed in the compression heat pump according to the present invention is generally between 0.1 mm and 5 mms, depending upon the material of construction, the specific evaporation or condensation to be carried out thereon and the form of surface features chosen. While the thickness of the plate may vary—and obviously will vary with some forms of surface features—in general when referring to plate thickness we refer to the plate thickness as it would be without those features. It will be appreciated that the thickness of the plates should be sufficient to provide the necessary rigidity under operating conditions but thin enough to permit high thermal flux from one face to another. Typically the plate thickness is between 0.25 mm and 1.25 mm.

The outer diameter of the plates used in the rotary compression heat pump of the present invention is typically in the range 10 cm to 5 meters and is preferably between about 50 cm and 100 cm and where the plates are in the form of annuli the inner diameter thereof is typically in the range 5 cm to 1 meter.

Where a component of a heat pump according to the present invention comprises a plurality of plates they are mounted substantially parallel to each other along the common axis about which they are able to rotate and are closely adjacent to one another to form narrow passages. Preferably the mean axial depth of the passages between adjacent plates is between 0.5 mm and 10 mm and more preferably is between 2 mm and 3 mm.

The plates used in rotary compression heat pumps according to the present invention are made of a suitable thermally conductive material which is able to withstand any environment to which it may be subjected during operation of the heat pump. As examples of suitable materials may be mentioned inter alia mild steel, stainless steel, copper and aluminuim.

The plates, in operation, are rotated at speed as to subject any liquid thereon to a mean acceleration, measured in a radial direction with respect to the axis of rotation, greater than the acceleration due to gravity, 'g'. The particular value selected depends upon such considerations as the size of the plates, the heat flow therethrough and the desired capacity of the heat pump in terms both of heat output and of quantity of liquid to be treated on the plates. In general, the acceleration may lie within the range from 5 to 1000 g, especially from 50 to 750 g and more preferably from 100 to 600 g.

In general when a plate bearing liquid upon a face thereof is rotated, the centrifugal effect tends to move that liquid in a direction generally away from the axis of rotation. Thus, a liquid to be evaporated from a plate in the evaporator of the heat pump according to the present invention is conveniently fed to the plate adjacent its axis of rotation, for example to the centre of the plate. Liquid formed by condensation on a face of a plate in the condenser of the heat pump of the present invention flows radially outwards and is discharged adjacent the periphery thereof. Vapour generated from a face of a plate in the evaporator may be discharged adjacent the axis or the periphery of the plate.

Typically the drive means used in the rotary heat pump according to the present invention is a belt driven by an electric motor. However, other drive means, e.g. direct drive from an electric motor, known in the rotary devices art may be used.

The compressor used in the rotary compression heat pump according to the present invention may be any suitable compressor which may be used for compressing a vapour and has a suitable capacity, conveniently it is of a gear pump type.

The working fluids which are suitable for use with the heat pump according to the present invention may be those which are already known in the compression heat pump field. Preferred working fluids are the chlorofluorohydrocarbons well known as refrigerants, for example Refrigerant 124, which is monochlorotetrafluoroethane, trichlorofluoromethane and 1,2,2-trichloro-1,1,2-trifluoroethane.

Depending on the nature of the working fluid it will be appreciated that to avoid condensation of working fluid vapour in the compressor the vapour often has to leave the evaporator under superheated conditions.

The ambient fluid source of heat which is fed to the evaporator may be water, for example from a river or pond, or preferably air.

The medium which is to be heated by absorbing heat in the condenser of the rotary compression heat pump according to the present invention may be a liquid, e.g. water, or preferably an innocuous gas, more preferably air.

It will be appreciated that where both the ambient fluid source of heat and the medium to be heated are air, the design of the heat pump according to the present invention may be such that its mode of operation may be reversed so that it may act, at different times, as both a heat pump and an air-conditioning cooling unit in a domestic environment.

It is believed that the present invention may better be understood by means of a detailed description of the structure and operation of specific embodiment and for this purpose reference is made to the accompanying drawings, in which.

Figure 1:
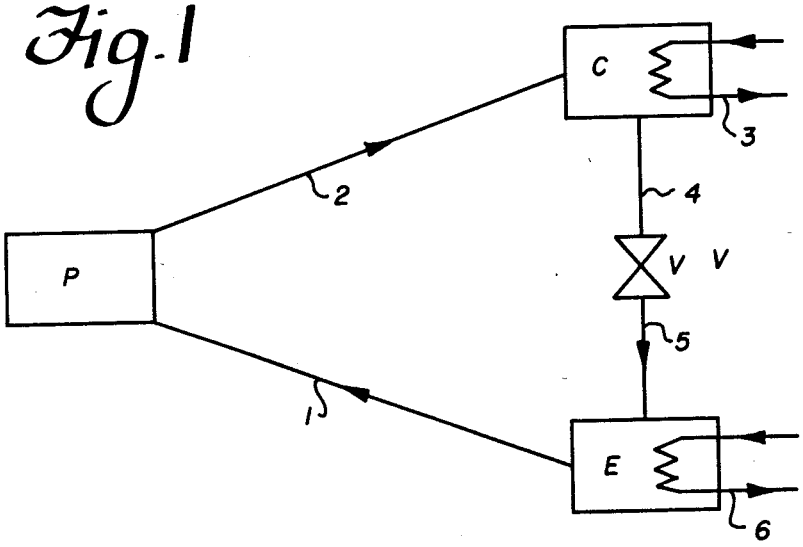
FIG. 1 illustrates in a simple schematic manner components of compression heat pump.

Referring firstly to FIG. 1, a working fluid such as a chlorofluorohydrocarbon refrigerant is circulated by means of a compressor P around a system consisting of a condenser C, a suitable valve V and evaporator E, in that sequence. In tee evaporator E, the working fluid is vaporised by heat exchange with a flow of an ambient source of heat flowing through line 6. The vapour passes via line 1 to the compressor P where its pressure is increased. Vapour from the compressor P is charged to the condenser C, in which it loses heat to a medium to be heated flowing in line 3 and is condensed to liquid. The liquid is finally returned to the evaporator E via line 4, an expansion valve V, and line 5.

As will be readily apparent, the heat input to the heat pump is the low grade heat taken from the ambient fluid at the evaporator E. The heat output is that taken up by the medium to be heated in the condenser C.

Figure 2:
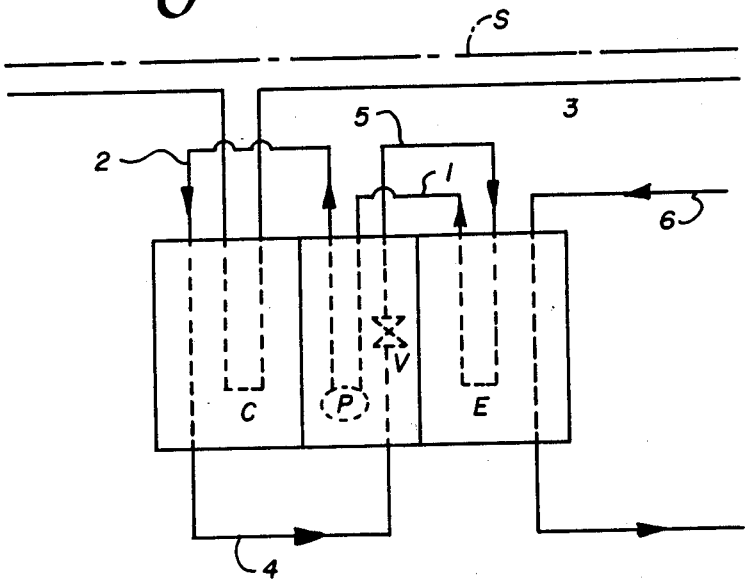
FIG. 2 illustrates the juxtaposition of those components and also the fluid flows, in an embodiment of the heat pump according to the present invention in which the fluid to be heated is liquid.

The embodiment of the heat pump according to the present invention illustrated schematically in FIG. 2 comprises the components of FIG. 1 mounted in the illustrated sequence upon a shaft at S, for rotation therewith. In that figure, parts corresponding to those of FIG. 1 are indicated by the use of the same numbering and lettering. As will be apparent, the sequence of flow of fluids through the heat pump is essentially the same as in FIG. 1, although the placing of the components in close juxtaposition upon a rotating shaft makes possible the assembly of a more compact unit than would be apparent from FIG. 1. The line 6 in FIG. 2 is the route by which ambient air is introduced to the evaporator. The line 3 in FIG. 2 is the route by which a liquid medium to be heated passes through the rotary compression heat pump.

Figure 3:
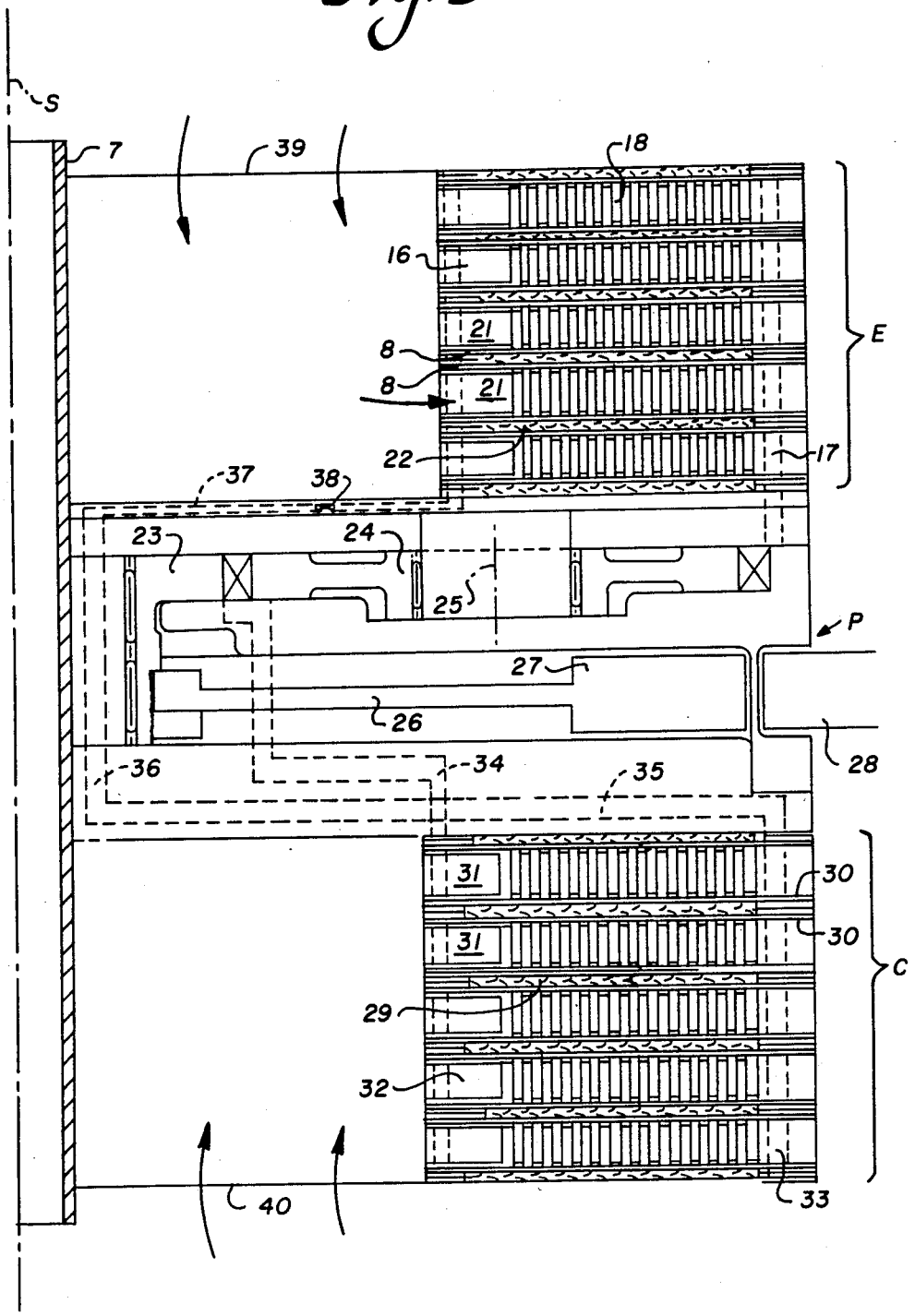
FIG. 3 is a radial sectional view of heat pump according to the present invention.

A heat pump according to the present invention in which the medium to be heated is gaseous is illustrated in radial section in FIG. 3, wherein the axis of rotation is again identified by the letter S. For ease of understanding, those portions of the heat pump rotor which perform functions already mentioned in connection with FIGS. 1 and 2, namely the condenser, compressor and evaporator, are indicated by the letters C, P, and E respectively.

Figure 4:
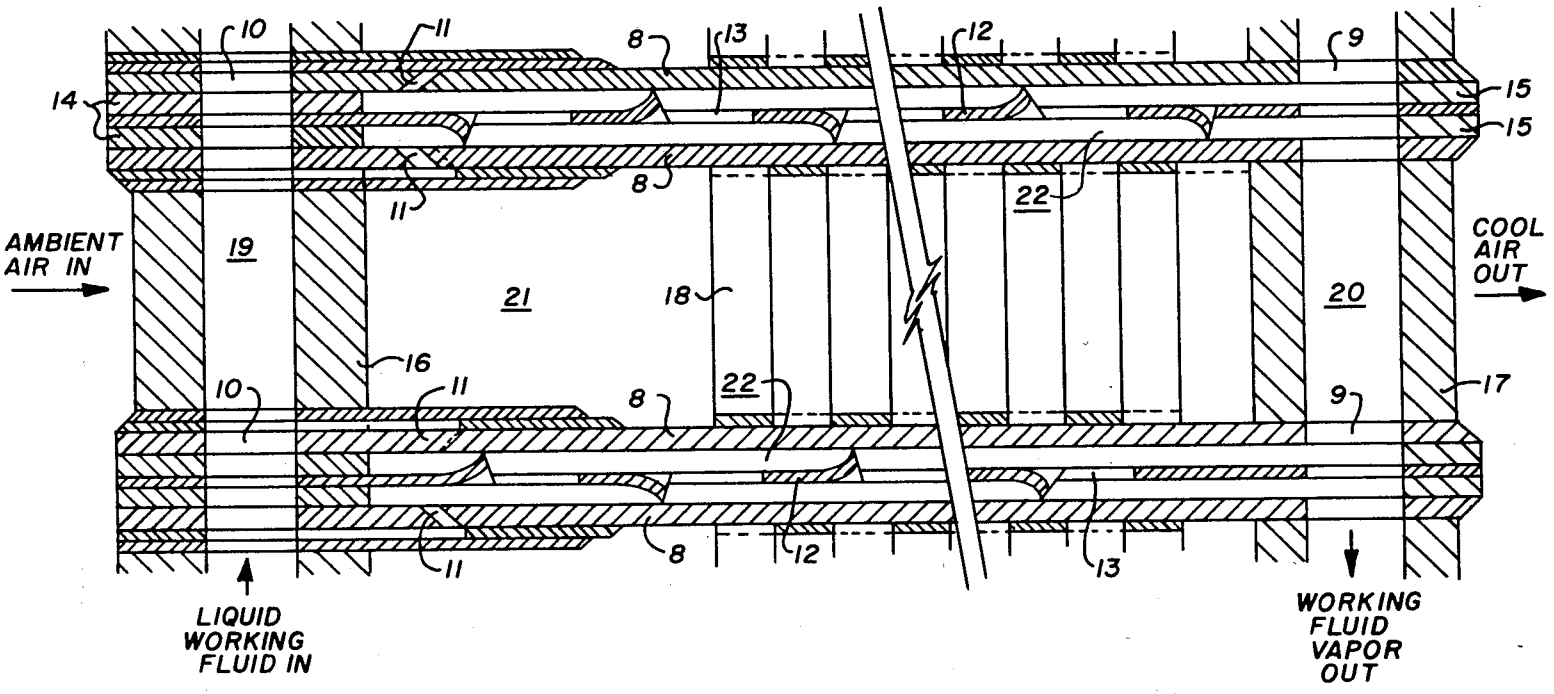
FIG. 4 is an enlarged view of a part of the heat pump illustrated in FIG. 3.
Figure 5:
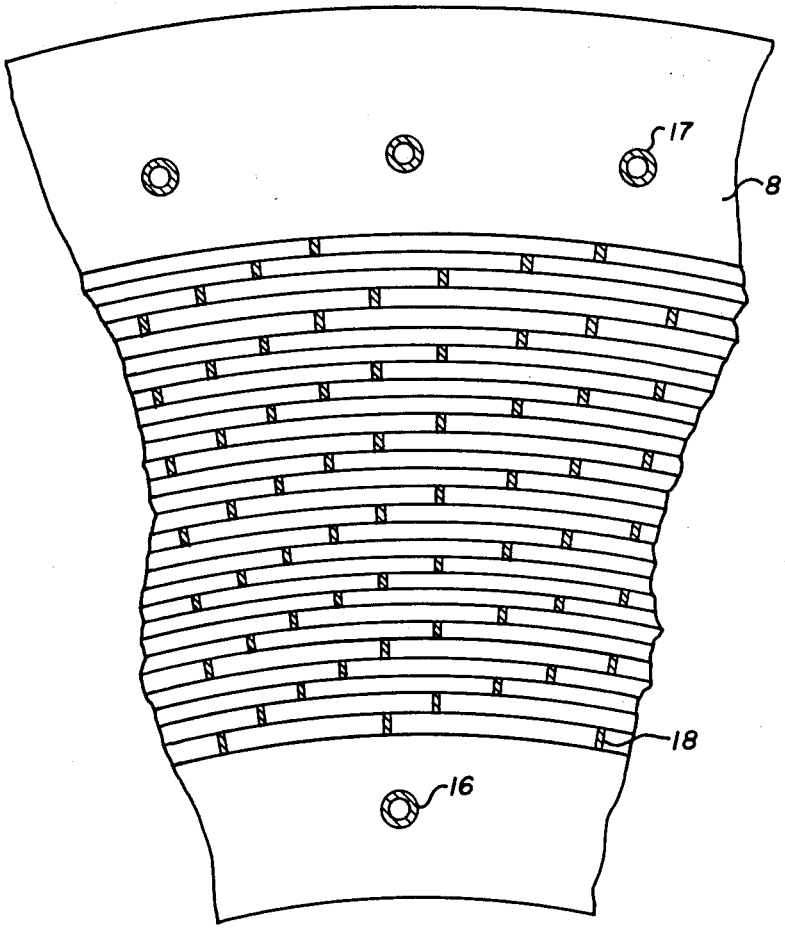
FIG. 5 is an enlarged view of a section of the heat pump illustrated in FIG. 3.

Referring now to FIGS. 3, 4 and 5 the illustrated heat pump is symmetrical about the axis S and is largely formed of a series of assorted discs and annular plates, of varying profiles. The discs and annular plates may be formed by stamping sheet metal and the heat pump may be assembled by stacking the discs and annular plates in appropriate sequence about a tubular conduit 7 which forms the axial support for the structure.

The evaporator E comprises a stack of annular plates 8. Each annular plate is provided with a set of orifices 9 in its radially outer region and two sets of orifices 10 and 11 in its radially inner region. The annular plates 8 are disposed in pairs, between the annular plates in each pair is mounted a separator plate 12. The separator plates 12 give support to the overall structure and also improve heat transfer. The separator plates have closely spaced holes 13 to allow passage of fluid and the edge of each hole nearest the axis of the heat pump is provided with a lip, rather like a cheese grater, to hold the plates with minimum contact area on the annular plates 8. Also between the plates in each pair are two gaskets 14, each of which is provided with a set of orifices, and two gaskets 15. The gaskets 14 and 15 and the pair of plates 11 define a chamber 22 through which working fluid flows.

In the passages 21 between adjacent pairs of plates 8 are disposed a radially inner set of tubes 16, a radially outer set of tubes 17 and fins 18 which are disposed substantially parallel to the axis of the rotor. The tubes 16 form with the orifices 10 and the orifices in gaskets 14, a manifold 19 for charging liquid working fluid to the evaporator. The tubes 17 form with the orifices 9 a manifold 20 for discharging working fluid vapour from the evaporator. The fins 18 assist the transfer of heat from air flowing through passageways 21 to working fluid liquid flowing through chambers 22.

The compressor P comprises a gear pump having a sun gear 23, mounted free to rotate about the conduit 7, and a planet gear 24, mounted within the rotor to rotate about an axis 25, while rotating with the rotor around the axis S. The sun gear 23 is secured to a metal disc 26, which carries a number of permanent magnets 27 within its periphery. Adjacent these magnets, spaced a short distance from the rotor, are stationed a corresponding number of permanent magnets 28. The magnets 27 and 28 co-operate to hold the sun gear 23 stationary. The planet gear 24 follows a rolling path around the periphery of the sun gear 23 and working fluid is pumped from the nip between the gears.

The condenser C is of a similar construction to evaporator E. It comprises chambers 29 through which working fluid flows in contact with the faces of a pair of plates 30; passages 31 through which the medium to be heated flows; manifold 32 for charging compressed working fluid vapour to the chambers 29; and manifold 33 for discharging liquid working fluid from the condenser.

A tube 34 provides fluid flow connection with the gear pump P and the manifold 32. Radially directed tubes 35, axially directed tubes 36 and radially directed tubes 37, in which is mounted a throttle valve 38, provide fluid flow connection between manifolds 33 and 19.

In operation of the heat pump, it is rotated by applying the drive to the conduit 7. Ambient air is drawn into the evaporator E via the aperture 39 and passes radially outwards through the annular air passages 21. Liquid working fluid, by absorbing heat from the air in passages 21, across the thickness of plates 8, is converted to vapour which flows radially outwards into manifold 20, adjacent to the outer circumferences of the rotor and thence to the compressor P.

From compressor P, vaporised working fluid is conveyed, under pressure, via tube 34 to the condenser C. In condenser C, the compressed vapour flows radially outwards through the radial passages 29. Vapour in the passages 29 condenses to form liquid working fluid on the faces of the plates 30 by loss of heat across the thickness of plates 30 to the gaseous medium to be heated, typically air, which enters the heat pump via aperture 40 and flows radially outward through the passages 31. The liquid working fluid is collected in manifold 33 adjacent the periphery of the rotor and is returned via tubes 35, 36 and 37 and throttle valve 38 to manifold 19.

Figure 6:
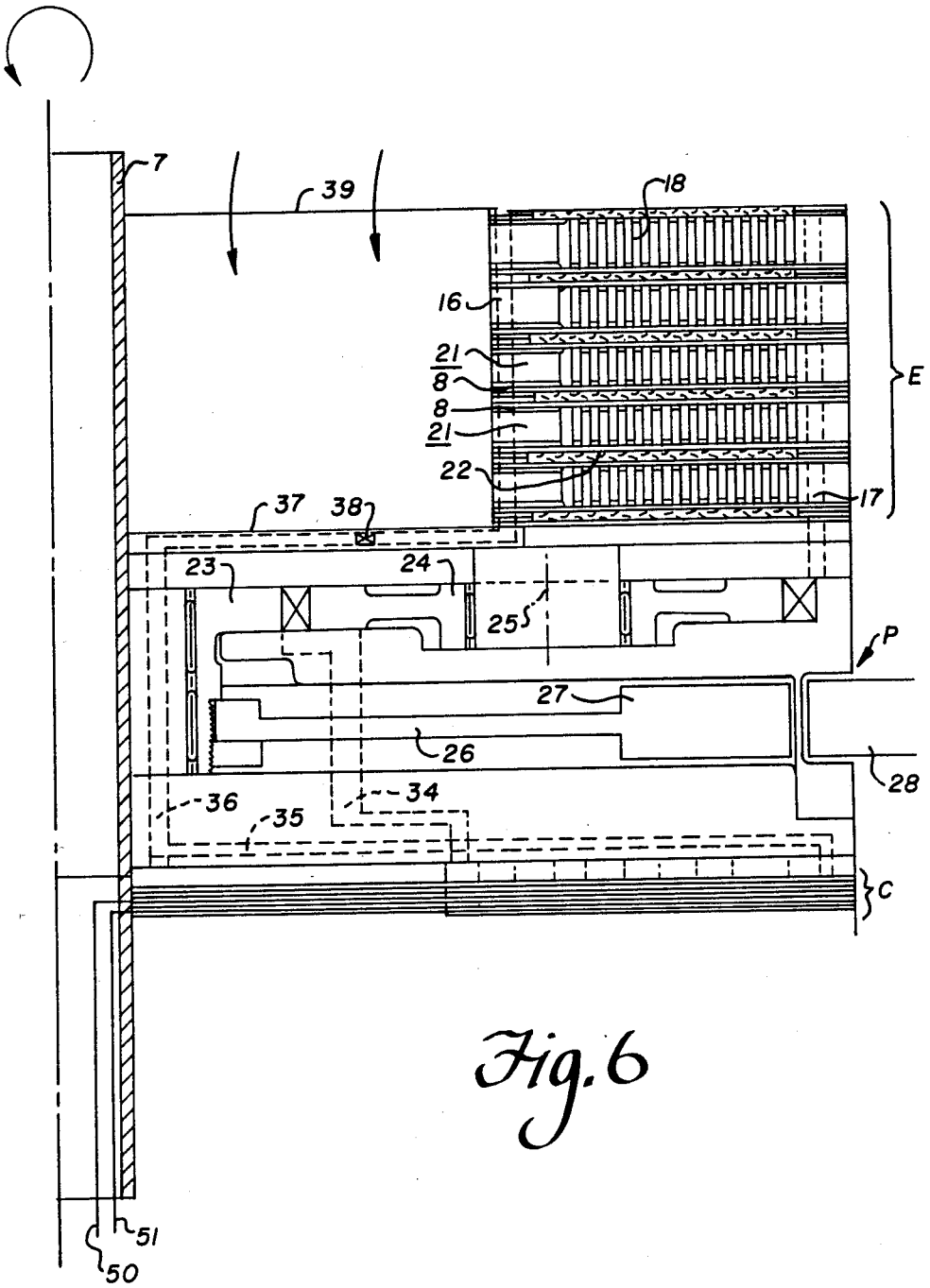
FIG. 6 is a radial sectional view of a heat pump according to the present invention.
Figure 7A:
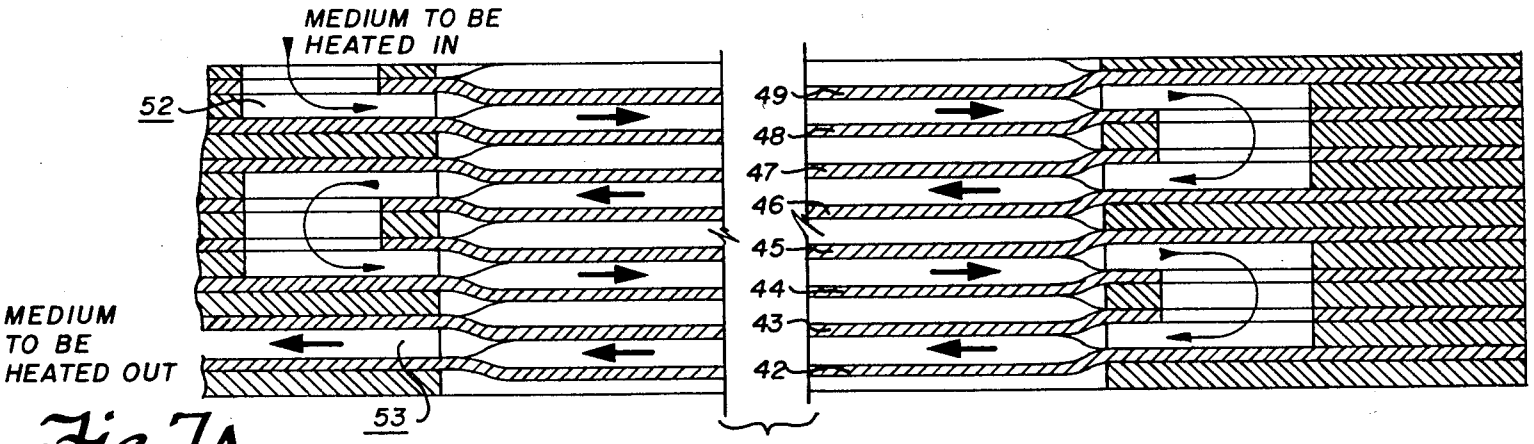
FIGS. 7*a* and 7*b* is an enlarged view of a part of the heat pump illustrated in FIG. 6.

A heat pump according to the present invention in which the medium to be heated is liquid is illustrated in radial section in FIG. 6, wherein the axis of rotation is again identified by the letter S. In FIGS. 6 and 7, parts corresponding to those of FIGS. 3 4 and 5 are indicated by use of the same numbering and lettering.

Referring now to FIGS. 6 and 7, the evaporator E and compressor P in FIG. 6 have the same structure and mode of operation as the evaporator and compressor in FIG. 3. From compressor P, vaporised working fluid is conveyed, under pressure, via tube 34 to the condenser C. In condenser C, the vapour is conveyed via a plurality of apertures 41, symmetrically disposed around the axis, to an assembly of plates 42, 43, 44, 45, 46, 47, 48 and 49 which are arranged to form alternate channels for flow of working fluid (illustrated in FIG. 7(*a*)) and liquid medium to be heated (illustrated in FIG. 7(*b*). The vapour flows between the plates and condenses on the faces thereof. Liquid working fluid flows radially outwards and is collected in manifold 33 adjacent the periphery of the rotor and is returned via tubes 35, 36 and 37 and throttle valve 38 to the chambers 22.

Figure 7B:
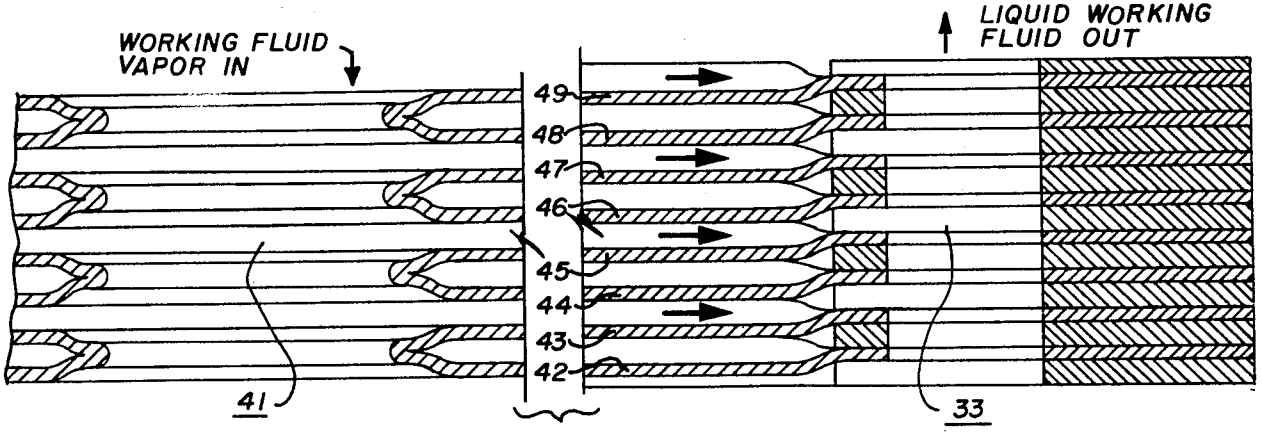

Liquid medium to be heated, typically water, is fed via line 50 in conduit 7 and a plurality of apertures 52, disposed symmetrically around the conduit and adjacent thereto, to the assembly of plates. In alternate channels for flow of the medium to be heated, as indicated in FIG. 7*b*, the water flows radially outwards and then radially inwards and gains heat across the thickness of the plates from condensation of the working fluid. The liquid medium to be heated is discharged via port 53 into line 51 in conduit 7.

The present invention is further illustrated by the following example.

EXAMPLE

In an embodiment of a rotary compression heat pump according to the present invention as illustrated in FIG. 6 in which an adiabatic throttle valve is used, the working fluid is a halogenated hydrocarbon refrigerant.

It is assumed that (a) superheated working fluid vapour leaves the evaporator at 273° K. and a vapour pressure of 0.25 bars, (b) the saturated liquid temperature in the evaporator is 268.2° K. and (c) that the liquid working fluid leaves the condenser at 341° K. and a vapour pressure of 3.5 bars.

It can be calculated that:

(a) the heat given out by the working fluid in the condenser is $23.7\times10^6$ J/K mol;

(b) the heat absorbed by the working fluid in the evaporator is $17.3\times10^6$ J/K mol;

(c) the work done by the compressor is $6.4\times10^6$ J/K mol; and (d) the coefficient of Performance (COP), defined by the equation $$COP = \frac{\text{Heat given out}}{\text{Work done}},$$

is 3.7.

We claim:

1. A compression heat pump, comprising:

an evaporator;

a compressor; and a condenser;

means operatively associating said evaporator, compressor and condenser to function as components of a compression heat pump;

at least one of said evaporator and condenser comprising at least one plate having two opposite faces separated by the thickness of such plate;

each said plate being mounted for rotation about an axis which extends at least generally parallel to the thickness direction of such plate;

means for charging a fluid at one temperature to one said face of each said plate and means for charging a fluid at another temperature to the respective opposite said face of such plate;

each said plate being constructed and arranged for accomplishing heat transfer from one said face to the respective opposite said face thereof;

said means for charging to the respective opposite said face of such plate, when forming part of said evaporator, being adapted to charge a liquid to be evaporated to such plate adjacent said axis of rotation thereof so that said liquid flows radially outwards across said opposite face as a continuous film of liquid; and said one face of such plate, when forming part of said condenser, being adapted to have vapor condense to a liquid thereon and flow radially outward as a thin film thereacross.

2. A compression heat pump as claimed in claim 1 wherein at least one of the components (excluding the compressor) is in the form of a plurality of axially-spaced, parallel, rotatable plates across the thickness of which plates a heat-transfer takes place.

3. A compression heat pump as claimed in claim 2 wherein both components are in the same form.

4. A compression heat pump as claimed in claim 1 which comprises:

(a) an evaporator, mounted upon a rotary shaft for rotation therewith and comprising at least one plate, across a first face of which an ambient fluid source of heat may flow and across the second face of which condensed working fluid may flow and may be evaporated therefrom;

(b) a condenser, mounted upon said rotary shaft for rotation therewith and comprising at least one plate to a first face of which vaporised working fluid under pressure may flow and across the second face of which a medium to be heated may flow;

(c) a compressor, mounted upon said rotary shaft and adapted to be driven thereby, and capable of accepting vaporised working fluid from the evaporator and delivering it under pressure to the condenser;

(d) a flow restriction valve to maintain the pressure in the condenser at an elevated level; and (e) drive means to rotate said rotary shaft.

5. A compression heat pump as claimed in claim 4 wherein the said first face of the at least one plate in the condenser has a surface which favours dropwise condensation of the vaporised working fluid and discourages formation of a continuous, stable liquid film, thereon.

6. A compression heat pump as claimed in claim 4 wherein the said second face of the at least one plate in the evaporator has a surface which assists retention of a continuous film of liquid thereon.

7. A compression heat pump as claimed in claim 3 wherein the mean axial depth of the passages formed between adjacent axially-spaced, parallel, rotatable plates is between 0.5 mm and 10 mm.

* * * * *